US008734092B1

(12) United States Patent
Spargo

(10) Patent No.: US 8,734,092 B1
(45) Date of Patent: May 27, 2014

(54) FLOOD PUMP

(76) Inventor: Rick D. Spargo, Hoxie, AR (US)

( * ) Notice: Subject to any disclaimer, the term of this patent is extended or adjusted under 35 U.S.C. 154(b) by 597 days.

(21) Appl. No.: 13/065,083

(22) Filed: Mar. 14, 2011

(51) Int. Cl.
*F04D 3/00* (2006.01)
*F04D 13/00* (2006.01)

(52) U.S. Cl.
USPC ..... 415/145; 415/220

(58) Field of Classification Search
USPC ..... 415/144, 145, 220, 221, 231, 234, 313, 415/300, 423.9; 251/101, 110–112; 417/231, 234, 313, 300, 423.9
See application file for complete search history.

(56) References Cited

U.S. PATENT DOCUMENTS 2,962,866 A 12/1960 Muehlfeld
3,008,422 A * 11/1961 Crisafulli ..... 417/234
3,170,646 A * 2/1965 Springer ..... 241/276
3,490,380 A * 1/1970 Beckett ..... 417/234
3,832,093 A 8/1974 Shirek et al.
4,175,916 A * 11/1979 Crisafulli ..... 417/231
4,483,509 A * 11/1984 Lewcock et al. ..... 251/86
5,364,233 A * 11/1994 Benoit ..... 417/231
6,988,874 B2 * 1/2006 Spargo ..... 417/234
8,007,249 B2 * 8/2011 Spargo ..... 417/231

* cited by examiner

*Primary Examiner* — Edward Look
*Assistant Examiner* — Jesse Prager
(74) *Attorney, Agent, or Firm* — R. Keith Harrison

(57) ABSTRACT

A flood pump includes a pump housing having a pump housing inlet and a pump housing outlet, an impeller housing disposed in fluid communication with the pump housing between the pump housing inlet and the pump housing outlet, an impeller disposed in the impeller housing, a power unit drivingly engaging the impeller, a diversion conduit disposed in fluid communication with the pump housing between the pump housing inlet and the pump housing outlet and a pump housing outlet valve in the pump housing between the diversion conduit and the pump housing outlet.

20 Claims, 5 Drawing Sheets

FLOOD PUMP

CROSS-REFERENCE TO RELATED APPLICATIONS

This application is related to application Ser. No. 11/820,637, filed Jun. 20, 2007 and entitled TILE FLOOD PUMP.

FIELD

The disclosure relates to pumping devices for pumping water from flooded areas. More particularly, the disclosure relates to a flood pump which is operable to selectively pump water from a flooded area to a river or other outlet or divert the pumped water to one or more alternative destinations for another use or uses.

BACKGROUND

In many areas around the world, levees are constructed along the bank of a river or other water body which has a tendency to flood periodically. The areas outside the levees may be low-lying areas which have a tendency to flood in heavy precipitation. These flood-prone areas may be used for farming or other purposes which may be hampered by a heavy water load. Therefore, it may be necessary to periodically pump water from a flood-prone low-lying area and discharge the water into a river or other water body. Alternatively, it may be desirable to divert the pumped water to a destination for irrigation and/or other purposes.

Accordingly, a flood pump which is operable to selectively pump water from a flooded area to a river or other outlet or divert the pumped water to one or more alternative destinations for another use is needed.

SUMMARY

The disclosure is generally directed to a flood pump which is operable to selectively pump water from a flooded area to a river or other outlet or divert the pumped water to one or more alternative destinations for another use. An illustrative embodiment of the flood pump includes a pump housing having a pump housing inlet and a pump housing outlet, an impeller housing disposed in fluid communication with the pump housing between the pump housing inlet and the pump housing outlet, an impeller disposed in the impeller housing, a power unit drivingly engaging the impeller, a diversion conduit disposed in fluid communication with the pump housing between the pump housing inlet and the pump housing outlet and a pump housing outlet valve in the pump housing between the diversion conduit and the pump housing outlet.

DETAILED DESCRIPTION

Figure 1:
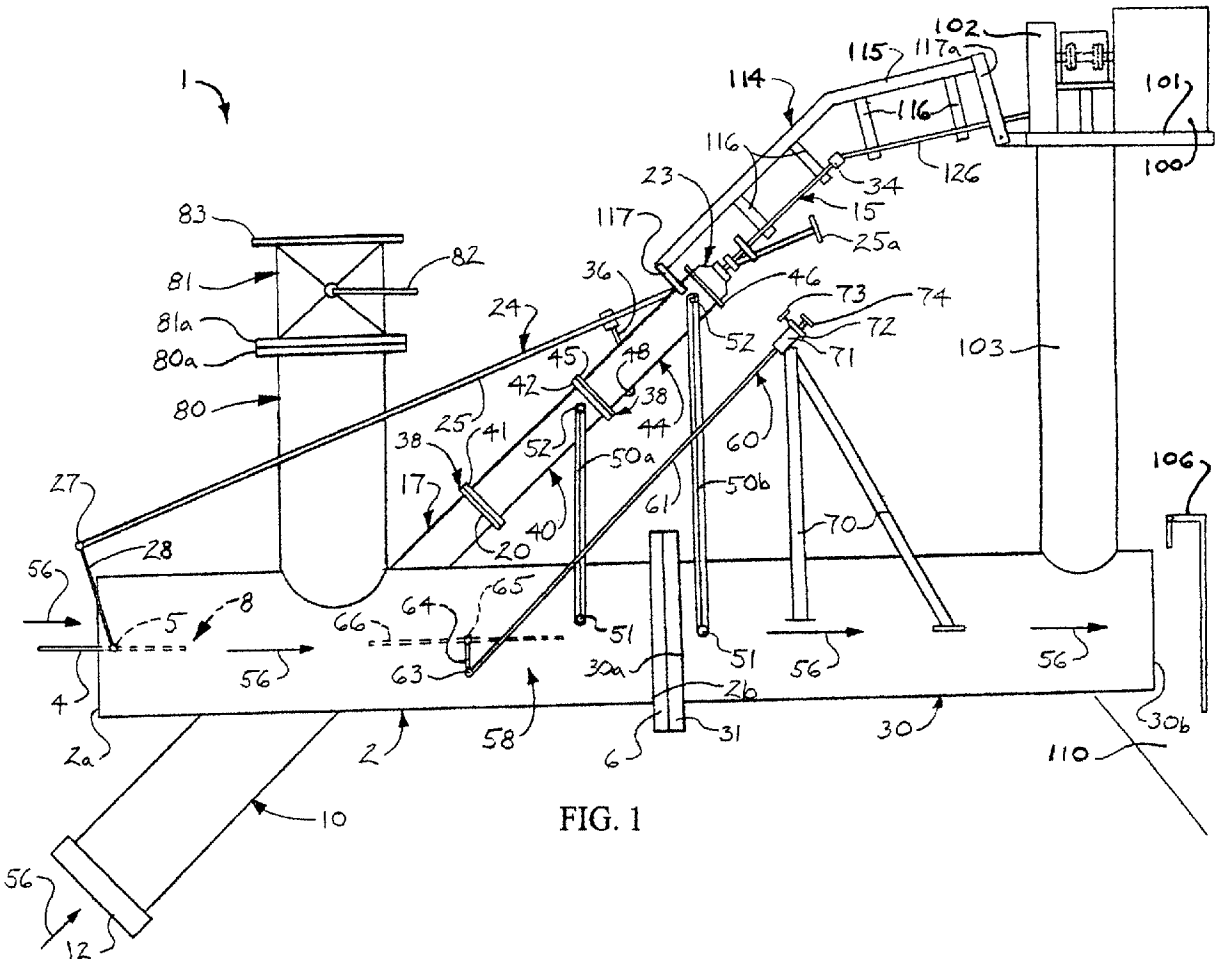
FIG. 1 is a side view of an alternative illustrative embodiment of the flood pump, with a pump housing outlet valve of the pump disposed in an open position.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Referring to FIGS. 1-7 of the drawings, an illustrative embodiment of the flood pump is generally indicated by reference numeral 1. The flood pump 1 may include a generally elongated pump housing 2 having a pump housing inlet 2*a* and a pump housing outlet 2*b*. A pump housing bore 3 (FIG. 5) may extend between the pump housing inlet 2*a* and the pump housing outlet 2*b*. A pump housing flange 6 may terminate the pump housing outlet 2*b* of the pump housing 2. The pump housing flange 6 may have pump flange openings 7 (FIG. 4) to facilitate bolted attachment of the pump housing flange 6 to a drain pipe flange 31 (FIG. 1) of a drain pipe 30 in exemplary application of the flood pump 1 which will be hereinafter described.

Figure 5:
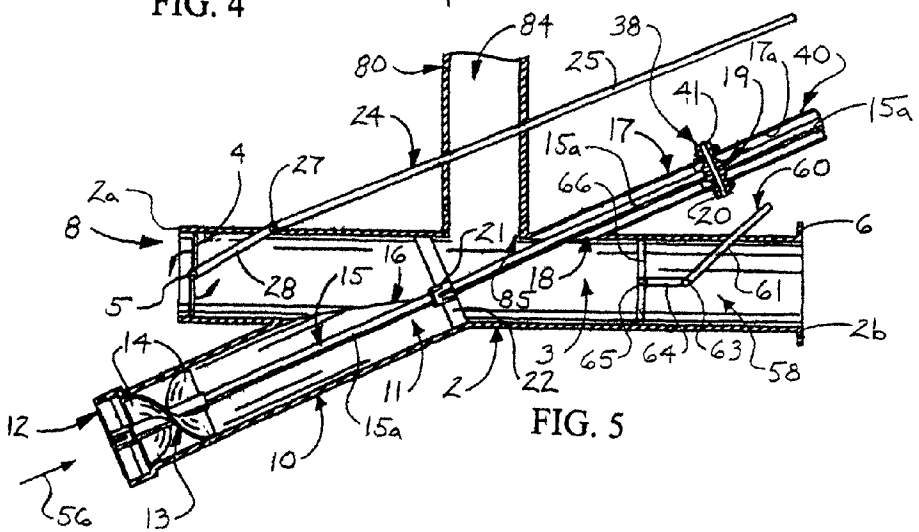
FIG. 5 is a sectional view, taken along section lines 5-5 in FIG. 4, of the flood pump.

As illustrated in FIGS. 1-5, an impeller housing 10 may extend from the pump housing 2. In some embodiments, the impeller housing 10 may extend in angular relationship downwardly and outwardly from the pump housing 2, as illustrated. As illustrated in FIG. 5, the impeller housing 10 may have an impeller housing bore 11 which is disposed in fluid communication with the pump housing bore 3 of the pump housing 2 through an impeller housing discharge opening 16. The impeller housing 10 may terminate in an intake grid 12. The intake grid 12 may serve as an intake for flowing water 56 during operation of the flood pump 1 which will be hereinafter described.

Figure 2:
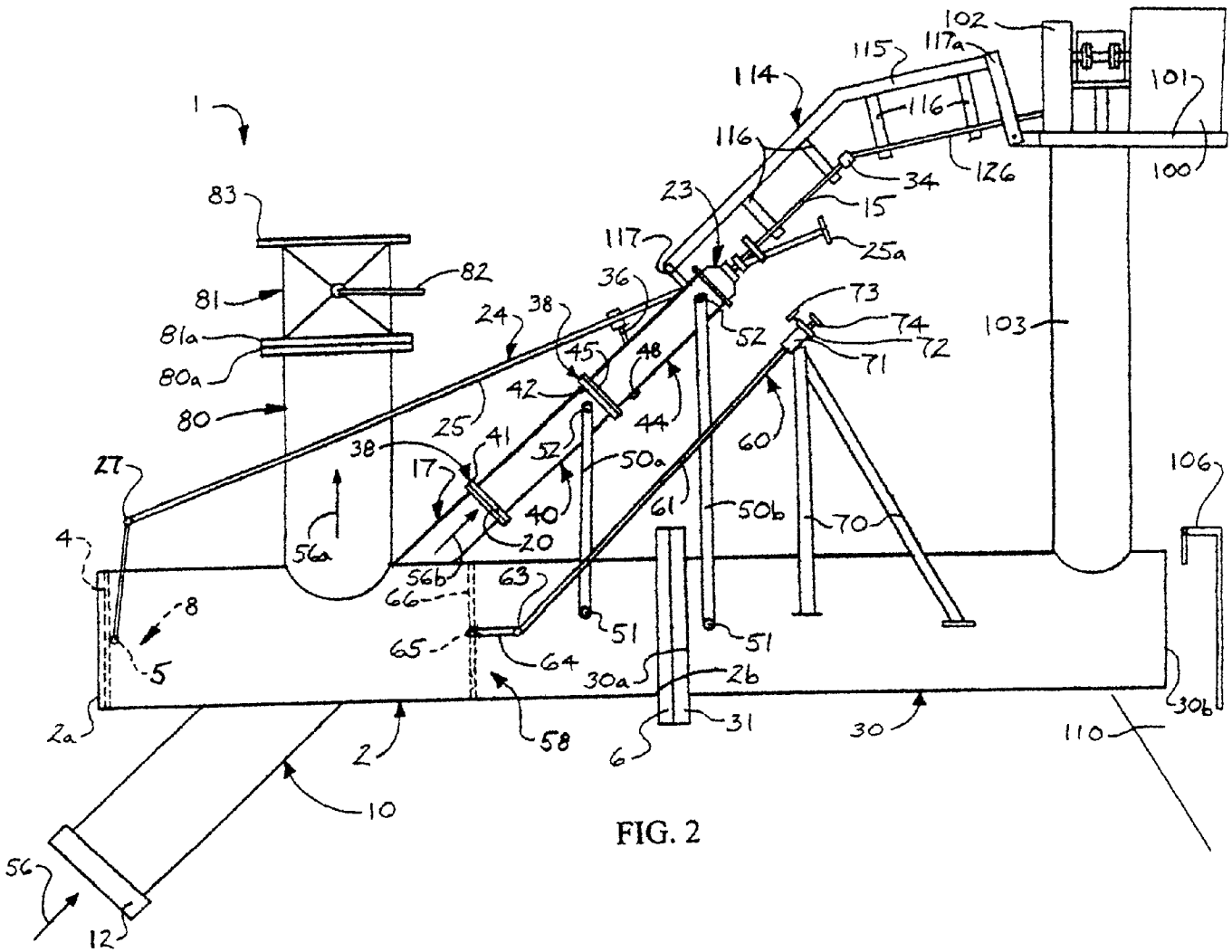
FIG. 2 is a side view of an alternative illustrative embodiment of the flood pump, with the pump housing outlet valve of the pump disposed in a closed position.

As illustrated in FIGS. 1-5, a shaft housing 17 may extend from the pump housing 2 in substantially aligned relationship to the impeller housing 10. In some embodiments, the shaft housing 17 may extend in angular relationship upwardly and outwardly from the pump housing 2, as illustrated. As illustrated in FIG. 5, the shaft housing 17 may have a shaft housing bore 17*a* which is disposed in fluid communication with pump housing bore 3 of the pump housing 2 at a shaft housing opening 18. In some embodiments, at least one shaft housing extension 40, 44 may extend from the shaft housing 17. The shaft housing extensions 40, 44 may be joined to the shaft housing 17 and to each other at housing extension joints 38. Accordingly, as illustrated in FIGS. 1 and 2, a shaft housing flange 20 may terminate the shaft housing 17. The shaft housing extension 40 may include a first housing extension flange 41 which is attached to the shaft housing flange 20 of the shaft housing 17 using bolts (not illustrated) and a second housing extension 42 (FIGS. 1 and 2) which is spaced-apart from the first housing extension flange 41. The second shaft housing extension 44 may include a first housing extension flange 45 which may be attached to the second housing extension flange 42 of the first shaft housing extension 40 using bolts (not illustrated) and a second housing extension flange 46 which is spaced-apart from the first housing extension flange 45. A water outlet 48 may be provided in the second shaft housing extension 44 for purposes which will be hereinafter described.

As illustrated in FIGS. 1 and 2, in some embodiments, a first housing extension support 50*a* and a second housing extension support 50*b* may stabilize the first shaft housing extension 40 and the second shaft housing extension 44, respectively, in the upwardly-extending angled configuration. A first fastener 51 may attach a lower end of the first housing extension support 50*a* to the pump housing 2. A second fastener 52 may attach an upper end of the first housing support 50*a* to the first shaft housing extension 40. Likewise, a first fastener 51 may attach a lower end of the second housing extension support 50*b* to the drain pipe 30. A second fastener 52 may attach an upper end of the second housing support 50*b* to the second shaft housing extension 44.

As illustrated in FIG. 5, an impeller shaft 15 may extend through the impeller housing bore 11 of the impeller housing 10 and through the shaft housing 17*a* of the shaft housing 17, intersecting the pump housing bore 3 of the pump housing 2. In the pump housing bore 3 of the pump housing 2, the impeller shaft 15 may extend through a marine bearing 21. The marine bearing 21 may be mounted on marine bearing mounts 22 in the pump housing bore 3. In some embodiments, the impeller shaft 15 may be constructed in multiple impeller shaft sections 15*a*. Adjacent impeller shafts 15*a* may be coupled to each other at a flange bearing 19. In some embodiments, the flange bearings 19 may be located generally at the housing extension joints 38 between the first shaft housing extension 40 and the shaft housing 17 and between the second shaft housing extension 44 and the first shaft housing extension 40. As illustrated in FIGS. 1 and 2, the impeller shaft 15 may extend from the second shaft housing extension 44 through an upper load bearing 23.

As illustrated in FIG. 5, an impeller 13 having at least one impeller flight 14 may be provided on the impeller shaft 15 in the impeller housing bore 11 of the impeller housing 10. The impeller 13 may be disposed adjacent to the intake grid 12 inside the impeller housing 10. Accordingly, responsive to rotation of the impeller 13 by the impeller shaft 15, the impeller flights 14 pull water 56 into the impeller housing bore 11 through the intake grid 12 as will be hereinafter further described.

The flood pump 1 may include a diversion conduit 80 having a diversion conduit interior 84 (FIG. 5) which communicates with the pump housing bore 3 of the pump housing 2 through a diversion conduit opening 85. The diversion conduit opening 85 may be generally adjacent to the shaft housing opening 18 which establishes fluid communication between the pump housing bore 3 of the pump housing 2 and the shaft housing bore 17*a* of the shaft housing 17. Accordingly, the diversion conduit 80 may extend from the pump housing 2 generally adjacent to the shaft housing 17, with the shaft housing 17 disposed in angular relationship to the diversion conduit 80. In application of the flood pump 1, which will be hereinafter described, the diversion conduit 80 may be adapted to divert a portion of the water 56*a* (FIG. 2) which is pumped by operation of the flood pump 1 to one or more destinations (not illustrated) for irrigation and/or other purposes.

Figure 3:
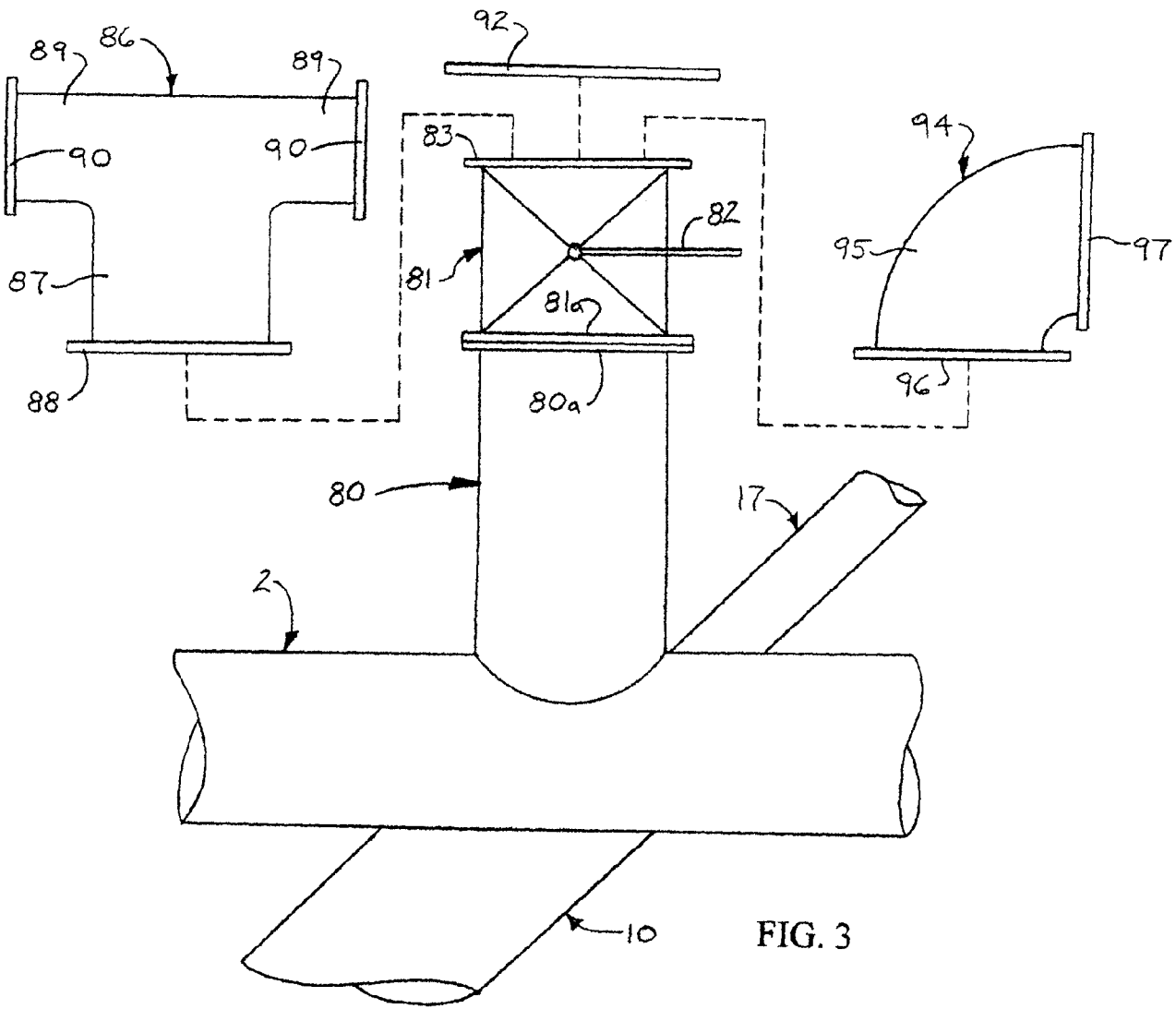
FIG. 3 is an exploded side view of the flood pump illustrated in FIGS. 1 and 2, more particularly illustrating alternative placement of a T-fitting, a valve cap and an elbow fitting on a diversion conduit of the pump.
Figure 4:
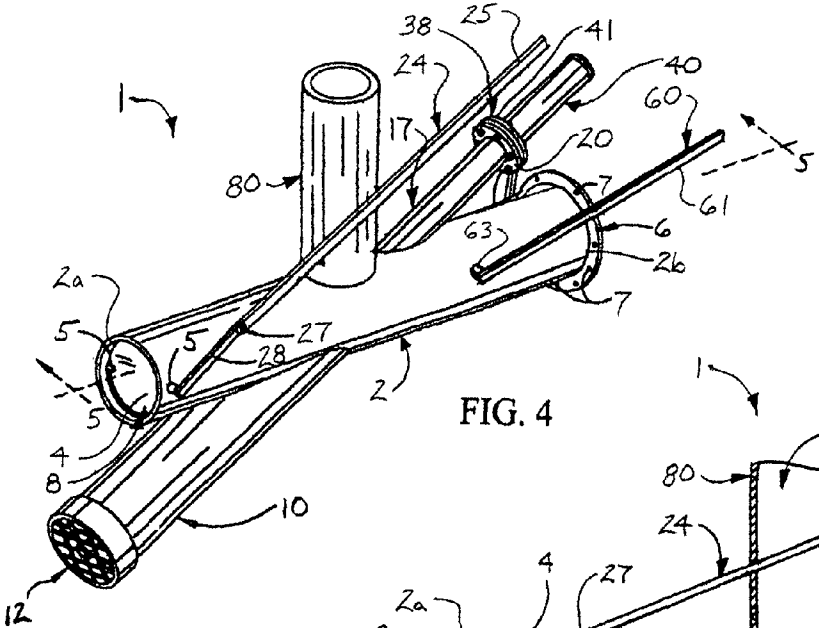
FIG. 4 is a perspective view, partially in section, of an illustrative embodiment of the flood pump.

As illustrated in FIGS. 1-3, a diversion conduit valve 81 may be provided on the diversion conduit 80. The diversion conduit valve 81 may be fitted with a valve handle 82, manipulation of which facilitates selective opening and closing of the diversion conduit valve 81 according to the knowledge of those skilled in the art. The diversion conduit valve 81 may be attached to the diversion conduit 80 typically by bolting a valve flange 81*a* on the diversion conduit valve 81 to a companion conduit flange 80*a* on the diversion conduit 80. As illustrated in FIG. 3, various attachments may be provided on the diversion conduit valve 81 depending on the desired application of the flood pump 1. In applications of the flood pump 1 in which distribution of water 56 (FIGS. 1 and 2) from the diversion conduit 80 to one or more destinations (not illustrated) is not desired, a valve cap 92 may be bolted and/or otherwise attached to a valve flange 83 on the diversion conduit valve 81. Additionally, the diversion conduit valve 81 may be closed by manipulation of the valve handle 82 to prevent flow of water 56 beyond the diversion conduit interior 84 (FIG. 5) of the diversion conduit 80. In applications in which water 56 is to be distributed from the diversion conduit 80 to two separate destinations for use, a T-fitting 86 may be disposed in fluid communication with the diversion conduit valve 81 and water conduits (not illustrated) may be disposed in fluid communication with the T-fitting 86 to distribute the water 56 to the destinations. In applications in which water 56 is to be distributed from the diversion conduit 80 to a single destination for use, an elbow fitting 94 may be disposed in fluid communication with the diversion conduit valve 81 and a water conduit (not illustrated) may be disposed in fluid communication with the elbow fitting 94 to distribute the water 54 to the destination.

The T-fitting 86 may include a valve attachment arm 87 which adapted for attachment to the diversion conduit valve 81. To that end, the valve attachment arm 87 may be fitted with an arm flange 88 which is adapted for typically bolted attachment to a companion valve flange 83 on the diversion conduit valve 81. A pair of oppositely-extending conduit attachment arms 89 may be disposed in fluid communication with the valve attachment arm 87. Each conduit attachment arm 89 may be fitted with an arm flange 90 for typically bolted attachment of a water conduit (not illustrated) to the corresponding conduit attachment arm 89. Accordingly, in application of the flood pump 1, which will be hereinafter described, a pair of water conduits (not illustrated) may be attached to the T-fitting 86 to divert water 56 (FIGS. 1 and 2) from the pump housing bore 3, through the diversion conduit 80 and the diversion conduit valve 81 to different destinations served by the water conduits attached to the T-fitting 86.

The elbow fitting 94 may include a generally curved elbow fitting conduit 95. A first conduit flange 96 and a second conduit flange 97 may be provided on opposite ends of the elbow fitting conduit 95. Accordingly, the elbow fitting 94 may be attached to the diversion conduit valve 81 by typically bolted attachment of the first conduit flange 96 to the valve flange 83. A water conduit (not illustrated) which distributes the water 56 to the desired destination may be attached to the second conduit flange 97 of the elbow fitting conduit 94 typically by bolted attachment.

As illustrated in FIGS. 1, 2, 4 and 5, pump housing inlet valve 8 may be provided in the pump housing bore 3 generally at the pump housing inlet 2*a*. In some embodiments, the pump housing inlet valve 8 may include a flapper valve disk 4 which can be selectively oriented in a closed position, as illustrated in FIG. 5, in which the plane of the flapper valve disk 4 is disposed in generally perpendicular relationship with respect to flow of water 56 through the pump housing bore 3, as will be hereinafter described. In the closed position, the flapper valve disk 4 may substantially prevent flow of water 56 into the pump housing bore 3 through the pump housing inlet 2*a*. Alternatively, the flapper valve disk 4 of the pump housing inlet valve 8 may be selectively oriented in an open position, as illustrated in FIGS. 1 and 2, in which the plane of the flapper valve disk 4 is disposed in parallel relationship with respect to the flow of water 56 through the pump housing bore 3. In the open position, the flapper valve disk 4 may facilitate substantially unhindered flow of water 56 into the pump housing bore 3 through the pump housing inlet 2*a*.

An inlet valve control 24 may operably engage the pump housing inlet valve 8 to facilitate selective opening and closing of the pump housing inlet valve 8. In some embodiments, the inlet valve control 24 may include a flapper valve connecting rod 28 which is pivotally attached to the flapper valve disk 4 at a flapper valve pin 5. A generally elongated flapper valve control rod 25 may pivotally engage the flapper valve connecting rod 28 at a control handle pivot 27. As illustrated in FIG. 1, a control rod grip 25*a* may terminate the flapper valve control rod 25. Accordingly, an operator (not illustrated) may grasp the control rod grip 25*a* and push the flapper valve control rod 25 such that the flapper valve control rod 25 pivots the flapper valve connecting rod 28 at the control handle pivot 27 and pivots the flapper valve disk 4 to the open position illustrated in FIGS. 1 and 2. Conversely, the operator may pull the flapper valve control rod 25 such that the flapper valve disk 4 is pivoted to the closed position illustrated in FIG. 5. As further illustrated in FIGS. 1 and 2, in some embodiments, a control rod support 36 may extend from a structural component of the flood pump 1, such as the second shaft housing extension 44, as illustrated, for example and without limitation, and engage the flapper valve control rod 25 for support purposes.

As further illustrated in FIGS. 1, 2 and 5, a pump housing outlet valve 58 may be provided in the pump housing bore 3 generally at or adjacent to the pump housing outlet 2*b*. In some embodiments, the pump housing outlet valve 58 may include a flapper valve disk 66 which can be selectively oriented in a closed position, as illustrated in FIGS. 2 and 5, in which the plane of the flapper valve disk 66 is disposed in generally perpendicular relationship with respect to flow of water 56 through the pump housing bore 3, as will be hereinafter described. In the closed position, the flapper valve disk 66 may substantially prevent flow of water 56 from the pump housing bore 3 through the pump housing outlet 2*b*. Additionally, as illustrated in FIG. 2, the closed flapper valve disk 66 may divert a first portion of the water 56*a* from the pump housing bore 3 (FIG. 5) of the pump housing 2 into the diversion conduit interior 84 (FIG. 5) of the diversion conduit 80 and a second portion of the water 56*b* from the pump housing 2 into the shaft housing bore 17*a* (FIG. 5) of the shaft housing 17. Alternatively, the flapper valve disk 66 of the pump housing outlet valve 58 may be selectively oriented in an open position, as illustrated in FIG. 1, in which the plane of the flapper valve disk 66 is disposed in generally parallel relationship with respect to the flow of water 56 through the pump housing bore 3. In the open position, the flapper valve disk 66 may facilitate substantially unhindered flow of water 56 from the pump housing bore 3 through the pump housing outlet 2*b* and into and through the drain pipe 30.

An outlet valve control 60 may operably engage the pump housing outlet valve 58 to facilitate selective opening and closing of the pump housing outlet valve 58. In some embodiments, the outlet valve control 60 may include a flapper valve connecting rod 64 which is pivotally attached to the flapper valve disk 66 at a flapper valve pin 65. A generally elongated flapper valve control rod 61 may pivotally engage the flapper valve connecting rod 64 at a control handle pivot 63. As illustrated in FIG. 1, a control rod grip 74 may terminate the flapper valve control rod 61. At least one control rod support 70 may extend upwardly from the drain pipe 30. A control rod collar 71 may be provided on the control rod support 70. A rod stop socket 72 may be provided on the control rod collar 71. The flapper valve control rod 61 may extend through the control rod collar 71 and the rod stop socket 72. A rod stop handle 73 may be threaded into a handle opening (not illustrated) in the rod stop socket 72. Accordingly, an operator (not illustrated) may grasp the control rod grip 74 and push the flapper valve control rod 61 such that the flapper valve control rod 61 pivots the flapper valve connecting rod 64 at the control handle pivot 63 and pivots the flapper valve disk 66 to the open position illustrated in FIG. 1. Conversely, the operator may pull the flapper valve control rod 61 such that the flapper valve disk 66 is pivoted to the closed position illustrated in FIGS. 2 and 5. The rod stop handle 73 may be threaded in the control rod collar 72 against the flapper valve control rod 71 to lock the flapper valve control rod 61 in place and the flapper valve disk 66 in the selected open or closed position in the pump housing bore 3.

As illustrated in FIGS. 1 and 2, a power unit 100 may drivingly engage the impeller shaft 15 in the shaft housing bore 17*a* (FIG. 5) of the shaft housing 17. In some embodiments, an impeller shaft extension 126 may be drivingly coupled to the impeller shaft 15 at a universal joint 34. The power unit 100 may drivingly engage the impeller shaft extension 126 through a gear box 102. The power unit 100 and the gear box 102 may be provided on a power unit stand 101 which may be elevated over the drain pipe 30 to which the pump housing 2 is attached. In some embodiments, a vertical stand support 103 may be upward-standing from the drain pipe 30. The power unit stand 101 may be supported by the stand support 103.

Figure 7:
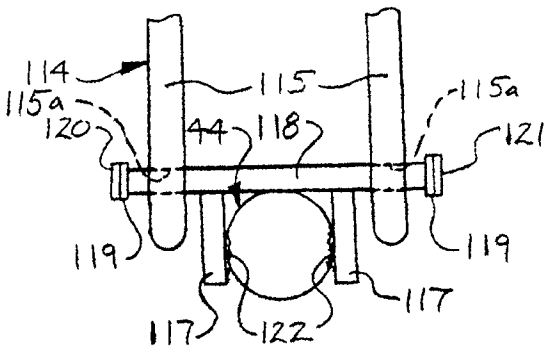
FIG. 7 is a top view of a portion of the flood pump, more particularly illustrating exemplary attachment of the driveline safety cage to the shaft housing extension of the shaft housing.
Figure 6:
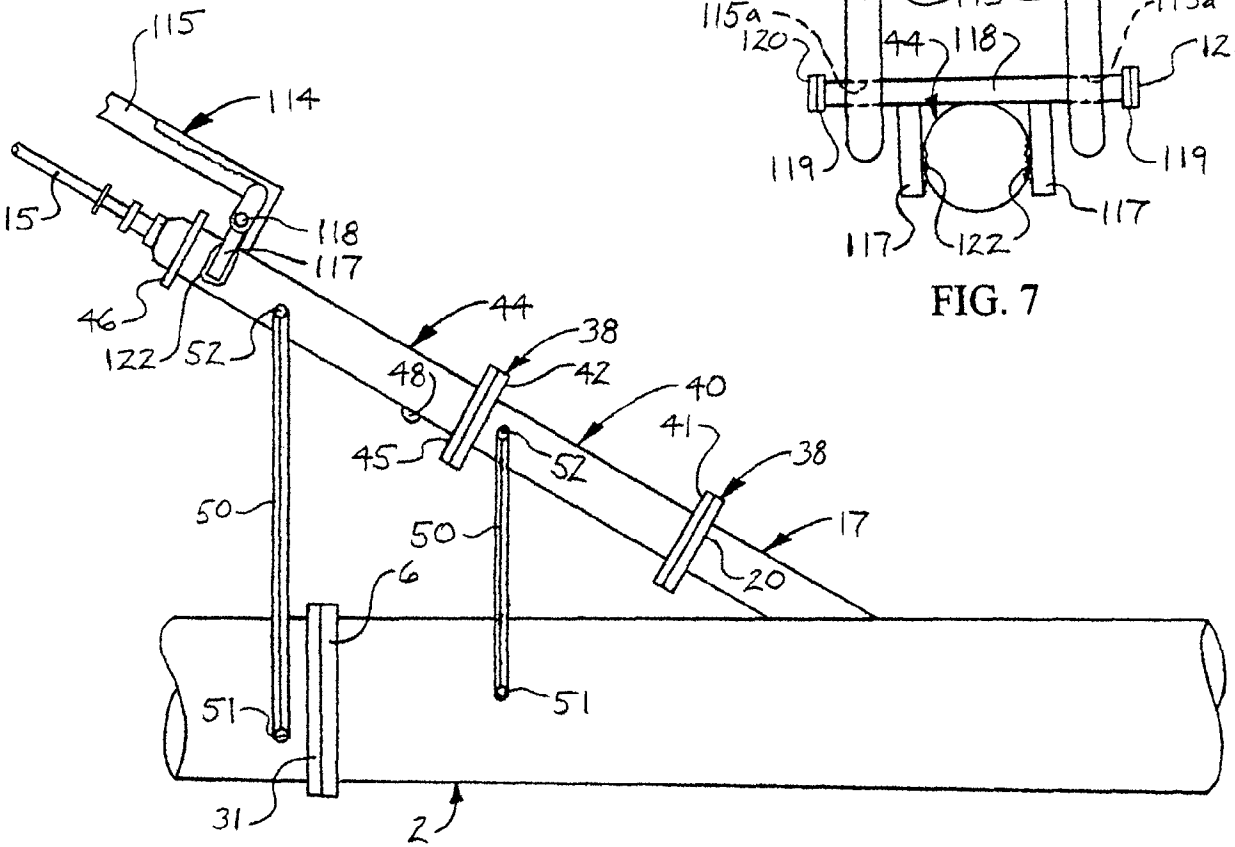
FIG. 6 is a side view, partially in section, of a portion of the flood pump, with a driveline safety cage (partially in section) attached to a shaft housing extension of a shaft housing on the flood pump.

A driveline safety cage 114 may extend over the impeller shaft 15, the universal joint 34 and the impeller shaft extension 126. The driveline safety cage 114 may include a pair of generally elongated, parallel, spaced-apart safety cage frames 115 (FIG. 7). A pair of lower end frame supports 117 may attach the safety cage frames 115 to the second shaft housing extension 44. A pair of upper end frame supports 117*a* (FIGS. 1 and 2) may attach the safety cage frames 115 to the power unit stand 101. As illustrated in FIG. 7, in some embodiments, a safety cage bolt 118 having a bolt head 120 may be extended through a pair of aligned bolt openings 115*a* in the respective safety cage frames 115. Lock washers 119 may be provided on respective ends of the safety cage bolt 118. A securing nut 121 may be threaded on the safety cage bolt 118. A pair of spaced-apart lower end frame supports 117 may extend downwardly from the safety cage bolt 118. The lower end frame supports 117 may be attached to the second shaft housing extension 44 at a pair of welds 122. As illustrated in FIGS. 1 and 2, in some embodiments, multiple shaft guards 116 may extend from the safety cage frames 115 and may be generally juxtaposed to the impeller shaft 15 and the impeller shaft extension 126 for protection purposes.

Referring again to FIGS. 1 and 2 of the drawings, in exemplary application, the flood pump 1 is installed adjacent to a river 110 to pump water 56 typically from a low-lying area (not illustrated) adjacent to the river 110 and discharge the drained water 56 into the river 110. Accordingly, the intake grid 12 on the impeller housing 10 of the flood pump 1 may be disposed in fluid communication with the area from which the water 56 is to be pumped. The pump housing 2 may be coupled to a drain pipe 30 which discharges the water 56 from the pump housing 2 into the river 110. The drain pipe 30 may have a drain pipe inlet 30*a* and a drain pipe outlet 30*b*. In some applications, the drain pipe 30 may extend through a levee (not illustrated) with the drain pipe inlet 30*a* and the drain pipe outlet 30*b* on opposite sides of the levee. A drain pipe flange 31 may be provided at the drain pipe inlet 30*a*. Accordingly, the pump housing outlet 2*b* of the pump housing 2 may be attached to the drain pipe inlet 30*a* of the drain pipe 30 by extending bolts (not illustrated) through pump flange openings 7 (FIG. 4) in the pump housing flange 6 and through registering bolt openings (not illustrated) in the drain pipe flange 31 on the drain pipe inlet 30*a* of the drain pipe 30. In some applications, the drain pipe outlet 30*b* of the drain pipe 30 may be disposed adjacent to a flood gate 106 which is adjacent to the river 110.

In some applications, a first portion of the water 56*a* (FIG. 2) which is pumped from the area to be drained by operation of the flood pump 1 may be distributed to one or two destinations (not illustrated). Accordingly, in applications in which the first portion of the water 56*a* is to be distributed to two destinations, the T-fitting 86 (FIG. 3) may be attached to the diversion conduit valve 81 on the diversion conduit 80 as was heretofore described with respect to FIG. 3. Water conduits (not illustrated) may be attached to the respective conduit attachment arms 89 of the T-fitting 86 to distribute the pumped water 56 to the respective destinations. In applications in which the first portion of the water 56*a* is to be distributed to a single destination, the elbow fitting 94 (FIG. 3) may be attached to the diversion conduit valve 81. A water conduit (not illustrated) may be attached to the elbow fitting 94 to distribute the pumped water 56 to the destination. Still further in the alternative, the valve cap 92 (FIG. 3) may be attached to the valve flange 83 of the diversion conduit valve 81 in applications in which a portion of the water 56 is not to be diverted to use at one or more destinations. In other applications, the first portion of the water 56*a* may be pumped into a retention tank (not illustrated) which may be attached to the valve flange 83 of the diversion conduit valve 81 on the diversion conduit 80.

The flapper valve disk 4 of the pump housing inlet valve 8 may be closed, as illustrated in FIG. 2, by operation of the inlet valve control 24. The power unit 100 (FIGS. 1 and 2) is operated to rotate the impeller shaft 15 in the impeller housing bore 11 (FIG. 5) of the impeller housing 10 through the gear box 102, the impeller shaft extension 126 and the universal coupling 34. The impeller shaft 15 rotates the impeller 13 (FIG. 5) in the impeller housing bore 11 of the impeller housing 10. Accordingly, the impeller flights 14 of the impeller 13 draw water 56 through the intake grid 12 into the impeller housing bore 11. The water 56 flows from the impeller housing bore 11 through the impeller housing discharge opening 16 into the pump housing bore 3.

In some applications, the water 56 flows from the pump housing bore 3 through the drain conduit 30 and is discharged into the river 110. Accordingly, prior to operation of the flood pump 1, the outlet valve control 60 is operated to orient the flipper valve disk 66 of the pump housing outlet valve 58 in the horizontal position illustrated in FIG. 1. The inlet valve control 24 may be operated to orient the flapper valve disk 4 of the pump housing inlet valve 8 in the vertical, closed position illustrated in FIG. 2. The horizontal flipper valve disk 66 facilitates substantially unimpeded flow of the pumped water 56 through the pump housing bore 3 of the pump housing 2 and into and through the drain pipe 30, at the drain pipe outlet 30*b* of which the water 56 is discharged into the river 110.

In some applications, the water 56 flows from the pump housing bore 3 through the diversion conduit opening 85 (FIG. 5) into the diversion conduit interior 84 of the diversion conduit 80. Accordingly, prior to operation of the flood pump 1, the outlet valve control 60 is operated to orient the flipper valve disk 66 of the pump housing outlet valve 58 in the vertical position illustrated in FIG. 2. The inlet valve control 24 may be operated to orient the flapper valve disk 4 of the pump housing inlet valve 8 in the vertical, closed position illustrated in FIGS. 2 and 5. The vertical flipper valve disk 66 substantially blocks flow of the pumped water 56 through the pump housing bore 3 of the pump housing 2 into the drain pipe 30. Therefore, a first portion of the pumped water 56*a* is diverted from the pump housing bore 3 of the pump housing 2 through the diversion conduit opening 85 (FIG. 5) and into the diversion conduit interior 84 of the diversion conduit 80. The valve handle 82 (FIG. 3) is manipulated to open the diversion conduit valve 81 such that the first portion of the pumped water 56*a* flows through the open diversion conduit valve 81 to one or two destinations depending on whether the T-fitting 86 (FIG. 3) or the elbow fitting 94 is coupled to the diversion conduit valve 81, as was heretofore described. In other applications, the first portion of the pumped water 56*a* flows into a retention tank (not illustrated) which is attached to the valve flange 83 of the diversion conduit valve 81 on the diversion conduit 80.

A second portion of the pumped water 56*b* (FIG. 2) is diverted from the pump housing bore 3 of the pump housing 2 through the shaft housing opening 18 (FIG. 5) and into the shaft housing interior 17*a* of the shaft housing 17. Therefore, the second portion of the pumped water 56*b* cools the flange bearings 19 in which the impeller shaft 15 rotates during operation of the flood pump 1. In some embodiments, at least one water outlet 48 (FIGS. 1 and 2) may be provided in the second shaft housing extension 44 to facilitate drainage of the second portion of the pumped water 56*b* from the shaft housing interior 17*a* of the shaft housing 17.

In applications in which the water 56 which is being drained has a depth which equals or exceeds the depth of the pump housing inlet 2*a* of the pump housing 2, or under circumstances in which the water is to be drained into the pump housing bore 3 of the pump housing 2 by gravity, the inlet valve control 24 may be manipulated to open the flapper valve disk 4 of the pump housing inlet valve 8 to the horizontal open position illustrated in FIG. 1. Accordingly, water 56 may flow into the pump housing bore 3 of the pump housing 2 through the pump housing inlet 2*a*. In some applications, the pump housing outlet valve 58 may be opened, as illustrated in FIG. 1, such that the water 56 flows from the pump housing bore 3 through the drain pipe 30 and is discharged into the river 110. In some applications, the pump housing outlet valve 58 may be closed as illustrated in FIGS. 2 and 5. Accordingly, in some applications, the head pressure of the water 56 which enters the pump housing inlet 2*a* of the pump housing 2 may be sufficient that the water 56 flows from the pump housing bore 3 of the pump housing 2 into and through the diversion conduit 80 for distribution via the T-fitting 86 or elbow fitting 94 (FIG. 3) or alternatively, into a retention tank (not illustrated) attached to the diversion conduit valve 81. In other applications, the power unit 100 (FIGS. 1 and 2) may be operated to rotate the impeller shaft 15 in the impeller housing bore 11 of the impeller housing 10 such that additional water 56 is drawn into the impeller housing 10 through the intake grid 12. Accordingly, a first portion of the pumped water 56*a* may be diverted from the pump housing bore 3 into the diversion conduit 80 and a second portion of the pumped water 56*b* may flow from the pump housing bore 3 into the shaft housing bore 17*a* of the shaft housing 17, as was heretofore described.

While various illustrative embodiments of the disclosure have been described above, it will be recognized and understood that various modifications can be made in the disclosure and the appended claims are intended to cover all such modifications which may fall within the spirit and scope of the embodiments of the disclosure.

What is claimed is:

1. A pump comprising:

a pump housing having a pump housing inlet and a pump housing outlet;

an impeller housing disposed in fluid communication with said pump housing between said pump housing inlet and said pump housing outlet;

an impeller disposed in said impeller housing;

a shaft housing disposed in fluid communication with said pump housing;

an impeller shaft in said shaft housing and drivingly engaging said impeller;

a power unit drivingly engaging said impeller shaft;

a diversion conduit disposed in fluid communication with said pump housing between said pump housing inlet and said shaft housing; and a pump housing outlet valve in said pump housing between said diversion conduit and said pump housing outlet, said pump housing outlet valve positional between an open position wherein fluid flows from said pump housing inlet past said diversion conduit and said shaft housing, respectively, through said pump housing outlet and a closed position wherein a first portion of the fluid flows from said pump housing through said diversion conduit and a second portion of the fluid simultaneously flows from said pump housing through said shaft housing.

2. The pump of claim 1 wherein said impeller housing is disposed at an angle with respect to said pump housing.

3. The pump of claim 1 wherein said pump housing outlet valve comprises a flapper valve disk pivotally mounted in said pump housing and an outlet valve control engaging said flapper valve disk.

4. The pump of claim 3 wherein said outlet valve control comprises a flapper valve control rod and a flapper valve connecting rod pivotally engaged by said flapper valve control rod and pivotally engaging said flapper valve disk.

5. The pump of claim 4 further comprising at least one control rod support and a control rod collar carried by said control rod support, and wherein said flapper valve control rod extends through said control rod collar.

6. The pump of claim 5 further comprising a rod stop socket carried by said control rod collar and a rod stop handle threadably engaging said rod stop socket and adapted to engage said flapper valve control rod.

7. The pump of claim 1 further comprising a pump housing inlet valve in said pump housing generally at said pump housing inlet.

8. The pump of claim 7 wherein said pump housing inlet valve comprises a flapper valve disk pivotally mounted in said pump housing, a flapper valve connecting rod pivotally engaging said flapper valve disk and a flapper valve control rod engaging said flapper valve connecting rod.

9. A pump comprising:

a pump housing having a pump housing inlet and a pump housing outlet;

an impeller housing disposed in fluid communication with said pump housing between said pump housing inlet and said pump housing outlet;

an impeller disposed in said impeller housing;

a shaft housing disposed in fluid communication with said pump housing and aligned with said impeller housing, said shaft housing having at least one fluid outlet;

an impeller shaft drivingly engaging said impeller and extending through said impeller housing and said shaft housing;

a drain pipe disposed in fluid communication with said pump housing outlet of said pump housing;

an elongated stand support carried by said drain pipe in perpendicular relationship thereto;

a power unit carried by said stand support, said power unit drivingly engaging said impeller shaft;

a diversion conduit disposed in fluid communication with said pump housing between said pump housing inlet and said shaft housing; and a pump housing outlet valve in said pump housing between said diversion conduit and said pump housing outlet, said pump housing outlet valve positional between an open position wherein fluid flows from said pump housing inlet, past said diversion conduit and said shaft housing, respectively, through said pump housing outlet and a closed position wherein a first portion of the fluid flows from said pump housing through said diversion conduit and a second portion of the fluid simultaneously flows from said pump housing through said shaft housing.

10. The pump of claim 9 wherein said impeller housing is disposed at an angle with respect to said pump housing.

11. The pump of claim 9 wherein said pump housing outlet valve comprises a flapper valve disk pivotally mounted in said pump housing and an outlet valve control engaging said flapper valve disk.

12. The pump of claim 11 wherein said outlet valve control comprises a flapper valve control rod and a flapper valve connecting rod pivotally engaged by said flapper valve control rod and pivotally engaging said flapper valve disk.

13. The pump of claim 12 further comprising at least one control rod support and a control rod collar carried by said control rod support, and wherein said flapper valve control rod extends through said control rod collar.

14. The pump of claim 13 further comprising a rod stop socket carried by said control rod collar and a rod stop handle threadably engaging said rod stop socket and adapted to engage said flapper valve control rod.

15. The pump of claim 9 further comprising a pump housing inlet valve in said pump housing generally at said pump housing inlet.

16. The pump of claim 15 wherein said pump housing inlet valve comprises a flapper valve disk pivotally mounted in said pump housing, a flapper valve connecting rod pivotally engaging said flapper valve disk and a flapper valve control rod engaging said flapper valve connecting rod.

17. A pump comprising:

a pump housing having a pump housing inlet and a pump housing outlet;

a pump housing inlet valve in said pump housing generally at said pump housing inlet;

an impeller housing disposed in fluid communication with said pump housing between said pump housing inlet and said pump housing outlet and disposed at an angle with respect to said pump housing;

an impeller disposed in said impeller housing;

a shaft housing disposed in fluid communication with said pump housing and aligned with said impeller housing and disposed at an angle with respect to said pump housing, said shaft housing having at least one fluid outlet;

an impeller shaft drivingly engaging said impeller and extending through said impeller housing and said shaft housing;

a universal joint drivingly engaging said impeller shaft and an impeller shaft extension drivingly engaging said universal joint;

a drain pipe disposed in fluid communication with said pump housing outlet of said pump housing;

an elongated stand support carried by said drain pipe in perpendicular relationship thereto;

a power unit carried by said stand support, said power unit drivingly engaging said impeller shaft extension;

a driveline safety cage including:

a first pair of frame supports carried by said shaft housing, a second air of frame supports carried by said power unit stand, a pair of parallel and spaced-apart safety cage frames carried by said first pair of frame supports and said second pair of frame supports and a plurality of shaft guards carried by said safety cage frames, said shaft guards juxtaposed to said impeller shaft and said impeller shaft extension;

a diversion conduit disposed in fluid communication with said pump housing between said pump housing inlet and said shaft housing; and a pump housing outlet valve in said pump housing between said diversion conduit and said pump housing outlet, said pump housing outlet valve positional between an open position wherein fluid flows from said pump housing inlet past said diversion conduit and said shaft housing, respectively, through said pump housing outlet and a closed position wherein a first portion of the fluid flows from said pump housing through said diversion conduit and a second portion of the fluid simultaneously flows from said pump housing through said shaft housing.

18. The pump of claim 17 further comprising a diversion conduit valve disposed in fluid communication with said diversion conduit and a valve handle operably engaging said diversion conduit valve to selectively open and close the diversion conduit valve.

19. The pump of claim 18 further comprising a selected one of a T-fitting having a valve attachment arm disposed in fluid communication with said diversion conduit valve and a pair of conduit attachment arms disposed in fluid communication with said valve attachment arm and an elbow fitting having a curved elbow fitting conduit disposed in fluid communication with said valve attachment arm.

20. The pump of claim 17 wherein said pump housing outlet valve comprises a flapper valve disk pivotally mounted in said pump housing and an outlet valve control having a flapper valve control rod and a flapper valve connecting rod pivotally engaged by said flapper valve control rod and pivotally engaging said flapper valve disk, and further comprising at least one control rod support and a control rod collar carried by said control rod support, and wherein said flapper valve control rod extends through said control rod collar.

* * * * *